US007382218B2

(12) United States Patent
Charvet

(10) Patent No.: US 7,382,218 B2
(45) Date of Patent: Jun. 3, 2008

(54) MICROMECHANICAL SWITCH AND PRODUCTION PROCESS THEREOF

(75) Inventor: Pierre-Louis Charvet, Saint-Martin-le-Vinoux (FR)

(73) Assignee: Commissariat a l'Energie Atomique, Paris (FR)

( * ) Notice: Subject to any disclaimer, the term of this patent is extended or adjusted under 35 U.S.C. 154(b) by 280 days.

(21) Appl. No.: 10/536,183

(22) PCT Filed: Dec. 9, 2003

(86) PCT No.: PCT/FR03/03641

§ 371 (c)(1),
(2), (4) Date: Jun. 23, 2005

(87) PCT Pub. No.: WO2004/064096

PCT Pub. Date: Jul. 29, 2004

(65) Prior Publication Data

US 2005/0280974 A1 Dec. 22, 2005

(30) Foreign Application Priority Data

Dec. 10, 2002 (FR) ..... 02/15605

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,046,659 | A * | 4/2000 | Loo et al. | 333/262 |
| 6,768,412 | B2 * | 7/2004 | Becka et al. | 337/36 |
| 6,876,282 | B2 * | 4/2005 | Andricacos et al. | 335/78 |
| 2005/0190023 | A1 * | 9/2005 | Nakatani et al. | 335/78 |

FOREIGN PATENT DOCUMENTS

WO WO 02/01584 A1 1/2002

* cited by examiner

*Primary Examiner*—Elvin Enad
*Assistant Examiner*—Bernard Rojas
(74) *Attorney, Agent, or Firm*—Oliff & Berridge, PLC

(57) ABSTRACT

The micromechanical switch comprises a deformable bridge (1), attached via its ends to a substrate (2), and actuating means (3) to deform the deformable bridge (1) so as to make an electric contact between a first conducting element (4) formed on the substrate (2), between the bridge (1) and the substrate (2), and a second conducting element (5), securedly affixed to a bottom face of the bridge. The second conducting element (5) is permanently connected, by means of a conducting line (6) securedly affixed to the bridge (1), to a third conducting element (7) arranged on the substrate (2) at the periphery of the bridge (1). The bridge (1) comprises a first insulating layer wherein a hole (10) is drilled, in which hole a conducting material is arranged salient from the bottom face of the bridge (1) so as to form the second conducting element (5).

15 Claims, 2 Drawing Sheets

MICROMECHANICAL SWITCH AND PRODUCTION PROCESS THEREOF

BACKGROUND OF THE INVENTION

The invention relates to a micromechanical switch comprising a deformable bridge, attached via its ends to a substrate, and actuating means to deform the deformable bridge so as to make an electrical contact between a first conducting element securedly affixed to the substrate and arranged between the bridge and the substrate, and a third conducting element arranged on the substrate at the periphery of the bridge.

STATE OF THE ART

Micromechanical switches often present problems concerning the contact resistances. For example, the contact resistance may fluctuate in time or be too high when the contact is not sufficiently intimate.

To switch a radiofrequency signal with a micromechanical switch, a known embodiment comprises a deformable bridge and first conducting elements designed to be connected to one another, arranged on a substrate between the substrate and the bridge. The bridge comprises a second conducting element on the bottom face thereof. The electrical contact between the first conducting elements is made when the bridge is deformed by actuating means so that the second conducting element touches all the first conducting elements. This however constitutes a hyperstatic structure (comparable with a table with four legs where one leg is superfluous), i.e. only one of the contacts is intimate and presents a low contact resistance whereas the contact resistances of the other contacts are higher. To ensure that the contact resistances of the different electrical contacts are substantially equal, a very great precision would be required when manufacturing the switch, which would make production thereof difficult and costly.

The document WO02/01584 describes a micromechanical switch comprising a metal bridge arranged on a substrate and deformable by means of an electrostatic actuator, and a conducting element arranged between the bridge and the substrate. Actuation of the electrostatic actuator causes deformation of the bridge so as to make an electrical contact between the bridge and the conducting element. The bridge can undergo strain hardening with use, which may lead to breaking thereof.

OBJECT OF THE INVENTION

The object of the invention is to remedy these shortcomings and more particularly to achieve a more robust switch, while avoiding hyperstatic structure problems.

According to the invention, this object is achieved by the appended claims and in particular by the fact that the deformable bridge comprises at least a first insulating layer wherein a hole is drilled, in which hole a conducting material is arranged salient from the bottom face of the bridge so as to form a second conducting element designed to come into contact with the first conducting element when deformation of the bridge takes place, a conducting line connecting the second conducting element to the third conducting element being arranged on the first insulating layer.

The invention also relates to a process for production of a switch according to the invention, wherein fabrication of the deformable bridge is achieved by:

deposition of a sacrificial layer above the first conducting element, deposition of a first insulating layer on the sacrificial layer, etching of a hole in the first insulating layer and in the sacrificial layer, deposition of a metal layer so as to fill the hole and form the second conducting element and the conducting line, removal of the sacrificial layer.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF PARTICULAR EMBODIMENTS

Figure 1:
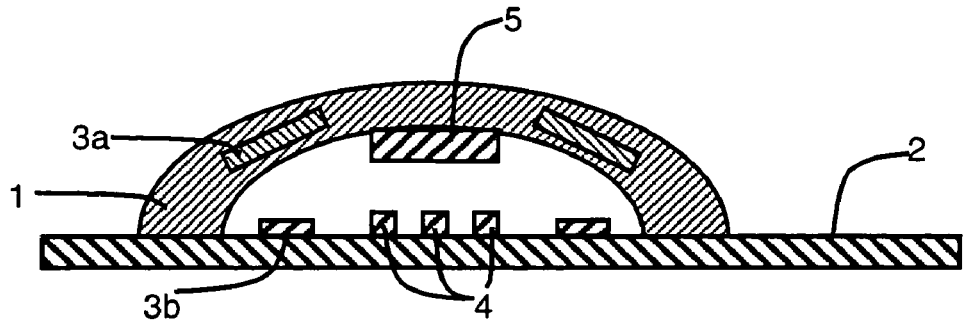
Figure 1 (Prior Art)
FIG. 1 represents a micromechanical switch according to the prior art.

The micromechanical switch represented in FIG. 1 is composed of a deformable bridge 1 attached via its ends to a substrate 2, and actuating means 3*a* and 3*b* designed to deform the deformable bridge 1 so as to make an electrical contact between first conducting elements 4 (three in FIG. 1) formed on the substrate 2 between the bridge 1 and substrate 2, and a second conducting element 5 securedly affixed to a bottom face of the bridge 1. This switch according to the prior art makes electrical contact between the first conducting elements 4 when the actuating means 3 deform the bridge 1.

Figure 2:
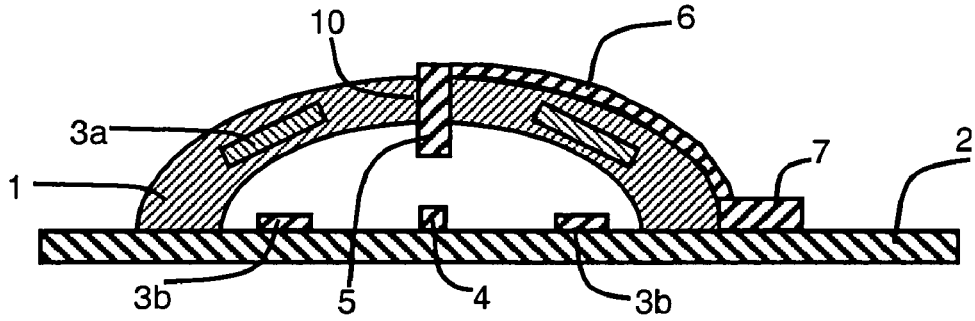
FIG. 2 represents a micromechanical switch according to the invention.

In the micromechanical switch represented in FIG. 2, the second conducting element 5 is permanently connected by means of a conducting line 6 securedly affixed to the bridge 1 to a third conducting element 7 arranged on the substrate 2 at the periphery of the bridge 1. Deformation of the bridge 1 makes an electrical contact, by means of the conducting line 6 and the second conducting element 5, between the third conducting element 7 and a single first conducting element 4, arranged facing the second conducting element 5.

In FIG. 2, the deformable bridge 1 is formed by a first insulating layer wherein a hole 10 is drilled, in which hole a conducting material is arranged salient from the bottom face of the bridge 1 so as to form a second conducting element 5 designed to come into contact with the first conducting element when deformation of the bridge 1 takes place. Thus, the bottom face of the bridge 1 is made of insulating material. A conducting line 6, arranged on the first insulating layer, connects the second conducting element 5 to the third conducting element 7.

The deformable bridge 1 can be formed by superposition of thin layers. Thus, a conducting layer constituting the conducting line 6 and connecting the second conducting element 5 and the third conducting element 7 can be formed on the first insulating layer. In an alternative embodiment, the second conducting element 5 and the conducting line 6 can be formed by a single conducting layer.

Figure 3:
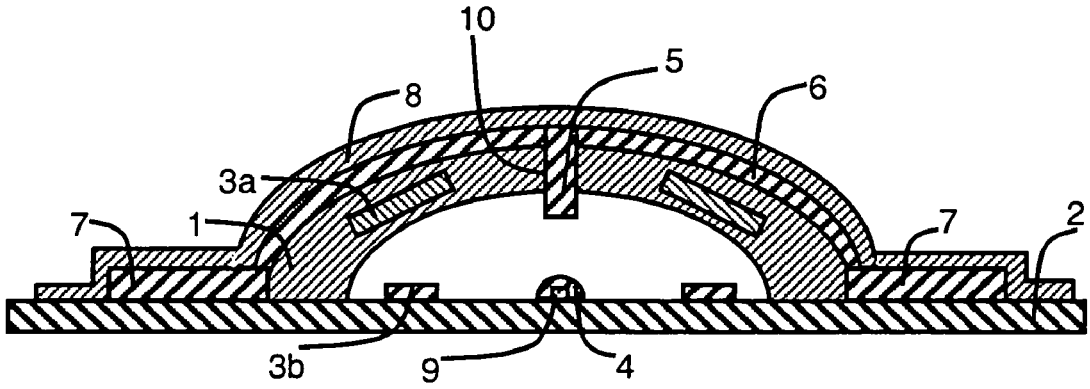
FIG. 3 represents a preferred embodiment of a micromechanical switch according to the invention.

As represented in FIG. 3, a second insulating layer 8 can be formed above the conducting line 6.

In the switch represented in FIG. 3, a conducting line 6 connects the second conducting element 5 to two third conducting elements 7 arranged on each side of the bridge 1. The bridge 1 can comprise an insulating layer 8 above the conducting line 6. An insulating layer 9 is preferably arranged between the first conducting element 4 and the substrate 2, the insulating layer 9 having smaller lateral dimensions than the lateral dimensions of the first conducting element 4, so that the first conducting element 4 is convex. Due to the convex shape of the first conducting element 4, the contact between the first conducting element 4 and the second conducting element 5 forms a localized contact at the center of the hump.

A switch according to the invention presents the advantage of being robust and of having a single contact which can be made sufficiently intimate by a suitable actuation. The contact resistance is consequently very low.

Figure 4:
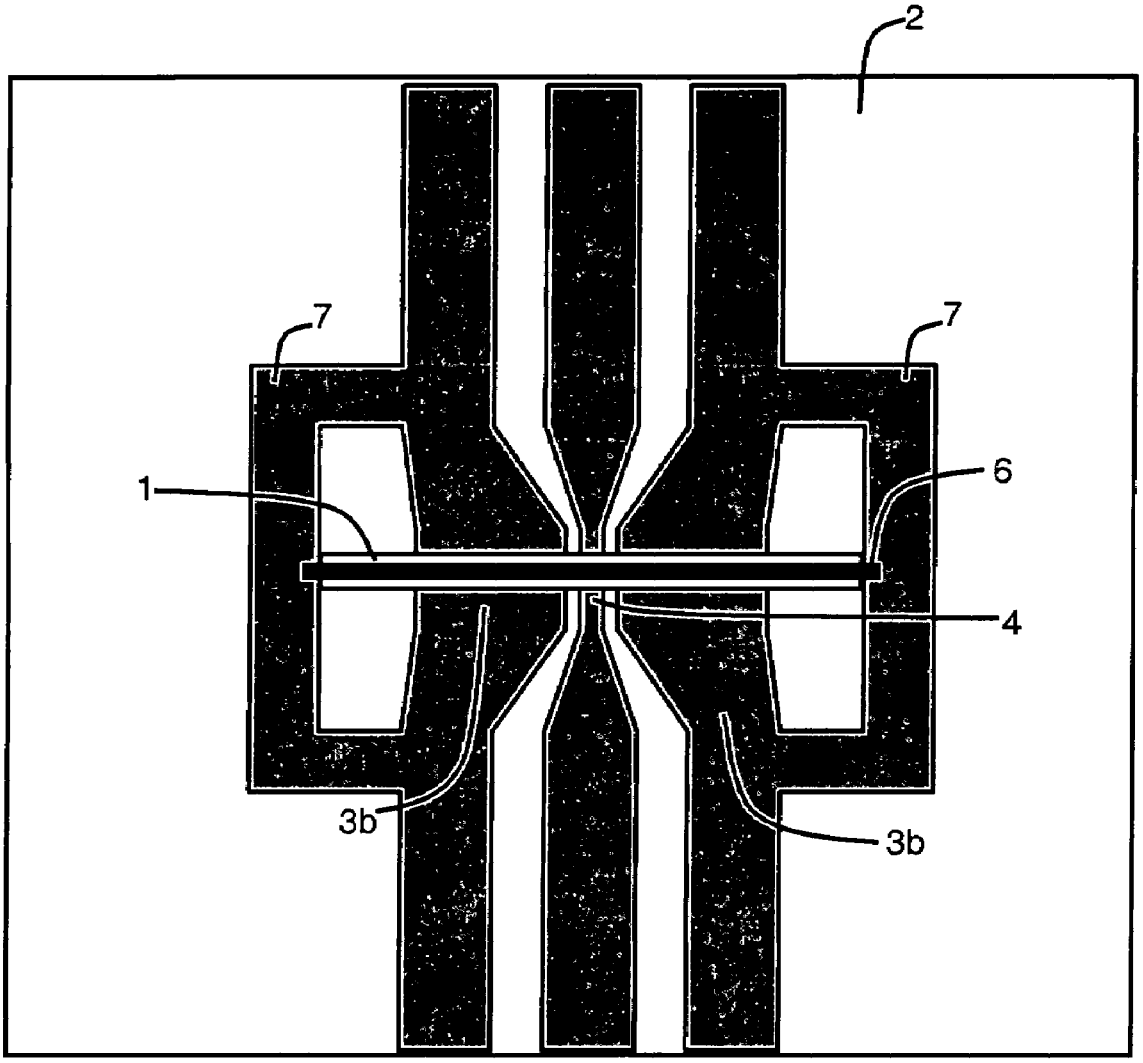
FIG. 4 represents a top view of an embodiment of a switch according to the invention.

For example, the micromechanical switch can be a normally open radiofrequency switch, the actuating means 3 comprising an electrostatic actuator. In this case, as represented in FIG. 4, the first conducting element 4 is a radiofrequency line. When the switch is open, the radiofrequency signal can pass via the radiofrequency line forming the first conducting element 4, contact losses thus being prevented. The actuating means 3 are preferably formed by electrodes 3*a* and 3*b* of an electrostatic actuator. The electrodes 3*a* can be arranged in the first insulating layer of the bridge 1, as represented in FIG. 3. The electrodes 3*a*, securedly affixed to the bridge 1, are connected to a voltage source. The electrodes 3*b*, formed on the substrate 2, between the deformable bridge 1 and the substrate 2, on each side of the radiofrequency line constituting the first conducting element 4, form two ground planes substantially parallel to the radiofrequency line. They thus perform a twofold function. Firstly, the electrodes 3*b* enable an attractive electric force to be established between the electrodes 3*a* and the electrodes 3*b* enabling the bridge 1 to be deformed when a voltage is applied between the electrodes 3*a* and 3*b*. Secondly, the electrodes 3*b* act as wave guide for the signal transmitted by the radiofrequency line constituting the first conducting element 4. In the application considered, the third conducting elements 7 are formed by electric ground planes arranged on the substrate 2 on each side of the deformable bridge 1. Thus, actuation of the switch establishes a contact between the radiofrequency line and the electric ground planes constituting the third conducting elements 7. The electric signal is then absorbed by the electric ground. The radiofrequency switch described above presents the advantage, in the on state, of transmitting the radiofrequency signal without any contact loss.

The whole of the radiofrequency component can be achieved on the substrate 2 by conventional integrated circuit fabrication techniques. The surface of the substrate 2, whereon the third and first conducting elements 4 and 7 are arranged, has to be made of insulating material to prevent permanent short-circuiting of the conducting elements. The insulating material is typically silicon oxide. In a preferred embodiment, an insulating layer 9 is deposited on the substrate 2 at the locations of the electrodes 3*b* and at the location of the first conducting element 4, the insulating layer 9 having smaller lateral dimensions than the lateral dimensions of the electrodes 3*b* and of the first conducting element 4 respectively. The material of the insulating layer 9 can for example be Si3N4 or SiO2. The first conducting element 4 and the electrodes 3*b* can be deposited on the insulating layer 9 by deposition of a metal layer, preferably of gold. The sacrificial layer can then be deposited above the first conducting element 4 and the electrodes 3*b*. The material of the sacrificial layer is typically a polymer material able to be easily removed after fabrication of the bridge. On the sacrificial layer, a layer of insulating material forming the framework of the bridge 1 is deposited. The insulating material of this layer can for example be Si3N4 or SiO2. To achieve an electrostatic actuator, the electrodes 3*a* can be fabricated by a metal deposition on the insulating layer forming the framework of the bridge 1 and covering of the electrodes 3*a* by an additional insulating layer (not shown) designed to insulate the electrodes 3*a* from the conducting line 6. The hole 10 is drilled by etching in the insulating layer forming the framework of the bridge 1, in the additional insulating layer and in the sacrificial layer. The second conducting element 5 and the conducting line 6 are then achieved, preferably simultaneously, by depositing a metal layer so as to fill the hole 10 and form a layer connecting the second conducting element 5 and the third conducting element 7. Preferably, a second insulating layer 8 (Si3N4 or SiO2) is deposited above the conducting elements. The sacrificial layer is then removed.

The invention claimed is:

1. Micromechanical switch, comprising a deformable bridge, attached via its ends to a substrate, and actuating means to deform the deformable bridge so as to make an electrical contact between a first conducting element securedly affixed to the substrate and arranged between the bridge and the substrate, and a third conducting element arranged on the substrate at the periphery of the bridge, switch wherein the deformable bridge comprises at least a first insulating layer wherein a hole is drilled, in which hole a conducting material is arranged salient from the bottom face of the bridge so as to form a second conducting element designed to come into contact with the first conducting element when deformation of the bridge takes place, a conducting line connecting the second conducting element to the third conducting element being arranged on the first insulating layer, wherein two ground planes are arranged on the substrate on each side of the bridge and connected to the second conducting element, the conducting line connecting the second conducting element to the two ground planes.

2. Switch according to claim 1, wherein the actuating means comprise an electrostatic actuator.

3. Switch according to claim 2, wherein the electrostatic actuator comprises electrodes arranged in the first insulating layer of the bridge.

4. Switch according to claim 1, wherein the first conducting element is a radiofrequency line and the third conducting element is an electric ground plane arranged on the substrate.

5. Switch according to claim 1, wherein the deformable bridge comprises at least one conducting layer forming the conducting line.

6. Switch according to claim 5, wherein the second conducting element and the conducting line are formed by a single conducting layer.

7. Switch according to claim 1, wherein the deformable bridge comprises at least a second insulating layer above the conducting line.

8. Micromechanical switch, comprising a deformable bridge, attached via its ends to a substrate, and actuating means to deform the deformable bridge so as to make an electrical contact between a first conducting element securedly affixed to the substrate and arranged between the bridge and the substrate, and a third conducting element arranged on the substrate at the periphery of the bridge, switch wherein the deformable bridge comprises at least a first insulating layer wherein a hole is drilled, in which hole a conducting material is arranged salient from the bottom face of the bridge so as to form a second conducting element designed to come into contact with the first conducting element when deformation of the bridge takes place, a conducting line connecting the second conducting element to the third conducting element being arranged on the first insulating layer, wherein a third insulating layer is arranged between the first conducting element and the substrate, the third insulating layer having smaller lateral dimensions than the lateral dimensions of the first conducting element, so that the first conducting element is convex.

9. Process for production of a micromechanical switch according to claim 1, comprising fabrication of the deformable bridge by:

deposition of a sacrificial layer above the first conducting element, deposition of a first insulating layer on the sacrificial layer, etching of a hole in the first insulating layer and in the sacrificial layer, deposition of a metal layer so as to fill the hole and form the second conducting element and the conducting line, removal of the sacrificial layer.

10. Switch according to claim 8, wherein the actuating means comprise an electrostatic actuator.

11. Switch according to claim 10, wherein the electrostatic actuator comprises electrodes arranged in the first insulating layer of the bridge.

12. Switch according to claim 8, wherein the first conducting element is a radiofrequency line and the third conducting element is an electric ground plane arranged on the substrate.

13. Switch according to claim 8, wherein the deformable bridge comprises at least one conducting layer forming the conducting line.

14. Switch according to claim 13, wherein the second conducting element and the conducting line are formed by a single conducting layer.

15. Switch according to claim 8, wherein the deformable bridge comprises at least a second insulating layer above the conducting line.

* * * * *